US011441576B2

(12) United States Patent
Ogawa et al.

(10) Patent No.: US 11,441,576 B2
(45) Date of Patent: Sep. 13, 2022

(54) DOUBLE-SUCTION CENTRIFUGAL PUMP

(71) Applicant: EBARA CORPORATION, Tokyo (JP)

(72) Inventors: Soichiro Ogawa, Tokyo (JP); Hiroyuki Kawasaki, Tokyo (JP); Takayuki Miyamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/252,932

(22) PCT Filed: May 29, 2019

(86) PCT No.: PCT/JP2019/021342
§ 371 (c)(1),
(2) Date: Dec. 16, 2020

(87) PCT Pub. No.: WO2019/244590
PCT Pub. Date: Dec. 26, 2019

(65) Prior Publication Data

US 2021/0115940 A1 Apr. 22, 2021

(30) Foreign Application Priority Data

Jun. 22, 2018 (JP) ..... JP2018-118401

(51) Int. Cl.
*F04D 29/42* (2006.01)
*F04D 1/00* (2006.01)
*F04D 29/28* (2006.01)

(52) U.S. Cl.
CPC ..... *F04D 29/426* (2013.01); *F04D 29/4233* (2013.01); *F04D 1/006* (2013.01); *F04D 29/281* (2013.01)

(58) Field of Classification Search
CPC .. F04D 29/426; F04D 29/406; F04D 29/4233; F04D 1/006
See application file for complete search history.

(56) References Cited

U.S. PATENT DOCUMENTS 2,287,397 A * 6/1942 Rupp ..... F04D 9/005 415/56.6
2015/0300365 A1 10/2015 Montemayor et al.
(Continued)

FOREIGN PATENT DOCUMENTS

CN 104421163 A 3/2015
CN 105650000 A 6/2016
(Continued)

OTHER PUBLICATIONS

International Search Report issued in Patent Application No. PCT/JP2019/021342 dated Aug. 13, 2019.
(Continued)

*Primary Examiner* — Sabbir Hasan
(74) *Attorney, Agent, or Firm* — Pearne & Gordon LLP

(57) ABSTRACT

The present invention relates to a reinforcing structure for a casing accommodating an impeller. A double-suction centrifugal pump includes: a rotational shaft (1); an impeller (2) secured to the rotational shaft (1); a casing (3) that accommodates the impeller (2) therein; and legs (5) secured to the casing (3). The casing (3) includes a suction volute (20) that communicates with a suction port (6), the casing (3) includes an upper casing (3*a*) and a lower casing (3*b*) fastened to each other, at least one rib (28A, 28B, 28C) is provided on each of both side surfaces of the lower casing (3*b*) constituting the suction volute (20), the rib (28A, 28B, 28C) extends in a radial direction of the rotational shaft (1) when viewed from an axial direction of the rotational shaft (1), and the rib (28A, 28B, 28C) is separated from the legs (5).

9 Claims, 8 Drawing Sheets

(56) References Cited

U.S. PATENT DOCUMENTS

| | | | | |
|---|---|---|---|---|
| 2017/0058915 | A1* | 3/2017 | Liang | F04D 13/0626 |
| 2018/0087512 | A1 | 3/2018 | Darley | |

FOREIGN PATENT DOCUMENTS

| | | | | | |
|---|---|---|---|---|---|
| CN | 107850079 | A | | 3/2018 | |
| JP | S54-35403 | U | | 3/1979 | |
| JP | 2013-204530 | A | | 10/2013 | |
| JP | 2014-206140 | A | | 10/2014 | |
| JP | 2014206140 | A | * | 10/2014 | |
| JP | 2017-044182 | A | | 3/2017 | |
| JP | 2017044182 | A | * | 3/2017 | |
| WO | WO-2013146719 | A1 | * | 10/2013 | F04D 1/006 |

OTHER PUBLICATIONS

Written Opinion issued in Patent Application No. PCT/JP2019/021342 dated Aug. 13, 2019.

* cited by examiner

DOUBLE-SUCTION CENTRIFUGAL PUMP

TECHNICAL FIELD

The present invention relates to a double-suction centrifugal pump, and more particularly to a reinforcing structure for a casing accommodating an impeller therein.

BACKGROUND ART

The double-suction centrifugal pump includes a rotational shaft to which a double-suction-type impeller is fixed, and a casing that accommodates the impeller therein and forms a flow path for a liquid. When the impeller is rotating in the casing, the liquid is pressurized in the casing, and the pressurized liquid is discharged to the outside through a discharge port.

When the pressure of the liquid acts on the casing, a high stress is generated in a part of the casing. As a result, and the casing may be deformed. If the casing is deformed, mating surfaces of casing flanges are separated, thus causing water leakage. Therefore, the casing is required to have rigidity to keep the deformation of the casing below a certain level.

Due to complexity of the casing shape of the double-suction centrifugal pump, the casing is typically manufactured by casting. If the entire casing has thick walls in order to increase the rigidity of the casing, the weight of the casing increases, and as a result, the weight of the entire double-suction centrifugal pump increases.

On the other hand, if the casing is made thinner, a mechanical strength of the casing is lowered. As a result, the double-suction centrifugal pump may not pass a water-pressure resistance test. This water-pressure resistance test is performed for the purpose of inspecting the double-suction centrifugal pump for water leakage. Specifically, the impeller and the rotational shaft are removed from the casing, and all openings including suction port and discharge port of the casing are closed to form a closed space inside the casing. Then, this closed space is filled with water having a pressure that is 1.5 times the maximum discharge pressure of the pump. The casing filled with the high-pressure water is left as it is for three minutes or more, so that water leakage and deformation of the casing are checked.

CITATION LIST

Patent Literature

Patent document 1: Japanese laid-open patent publication No. 2017-44182

Patent document 2: Japanese laid-open patent publication No. 2014-206140

SUMMARY OF INVENTION

Technical Problem

In this water-pressure resistance test, the casing is subjected to a higher pressure than that during normal operation. Therefore, a high stress is generated in the casing. As a result, a portion of the casing having a large area, such as a suction volute, may be deformed beyond a permissible level.

It is therefore an object of the present invention to provide a double-suction centrifugal pump capable of suppressing deformation of a casing without making the casing thick.

Solution to Problem

In an embodiment, there is provided a double-suction centrifugal pump comprising: a rotational shaft; an impeller secured to the rotational shaft; a casing that accommodates the impeller therein; and legs secured to the casing, wherein the casing includes a suction volute that communicates with a suction port, the casing includes an upper casing and a lower casing fastened to each other, at least one rib is provided on each of both side surfaces of the lower casing constituting the suction volute, the rib extends in a radial direction of the rotational shaft when viewed from an axial direction of the rotational shaft, and the rib is separated from the legs.

In an embodiment, the rib has a height that gradually decreases with a distance from an upper end of the rib.

In an embodiment, the lower casing has a semicircular annular portion extending along a circumferential surface of the rotational shaft, and upper end of the rib is connected to the semicircular annular portion.

In an embodiment, the rib has a lower end smoothly connected to an outer surface of the lower casing.

In an embodiment, the rib provided on each of both side surfaces of the suction volute comprises a plurality of ribs.

In an embodiment, at least one of the plurality of ribs has a cross section different from a cross section of other one of the plurality of ribs.

In an embodiment, the plurality of ribs are located in a fan-shaped area whose central line coincides with a vertical line passing through a central axis of the rotational shaft when viewed from the axial direction of the rotational shaft, and a central angle of the fan-shaped area is 140 degrees or less.

In an embodiment, the legs are located on extension lines of the plurality of ribs.

In an embodiment, the plurality of ribs have different lengths, and the rib closer to the suction port is longer.

In an embodiment, the double-suction centrifugal pump further comprises at least one upper rib provided on an outer surface of the upper casing.

In an embodiment, the double-suction centrifugal pump further comprises at least one bottom rib provided on a bottom of the lower casing.

Advantageous Effects of Invention

According to the invention described above, the ribs are not connected to the legs and are separated from the legs. The legs have not only a function of supporting the casing, but also a function of suppressing vibration of the casing during pump operation. Therefore, in general, the positions of the legs are inevitably determined from this point of view. In contrast, the positions of the ribs are determined based on a size and a position of an area of the casing where a high stress is generated. Since the ribs are separated from the legs, the degree of freedom in the positions of the ribs is increased. Further, the number of ribs can be appropriately determined without depending on the legs. Therefore, the ribs can be appropriately located at a position where reinforcement of the lower casing is required.

DESCRIPTION OF EMBODIMENTS

Figure 1:
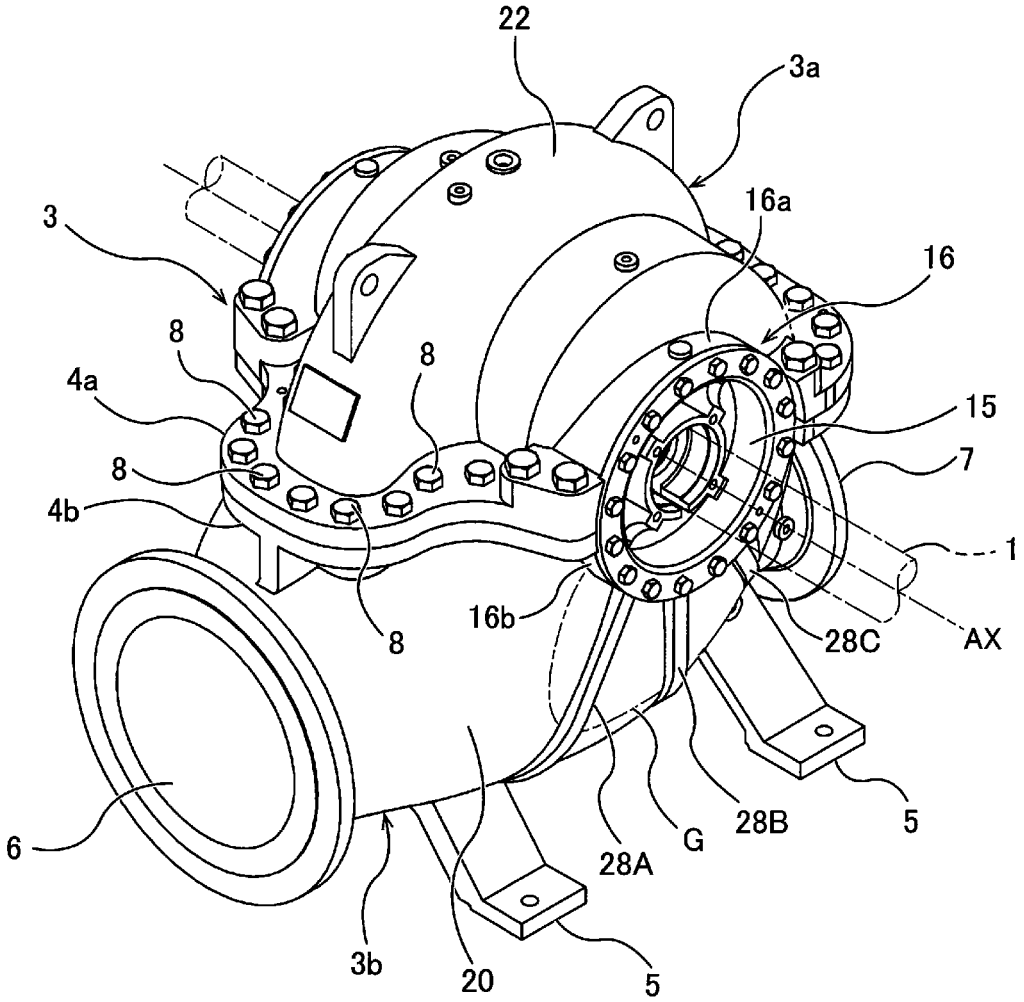
FIG. 1 is a perspective view of an embodiment of a double-suction centrifugal pump of the present invention as viewed obliquely from above.
Figure 2:
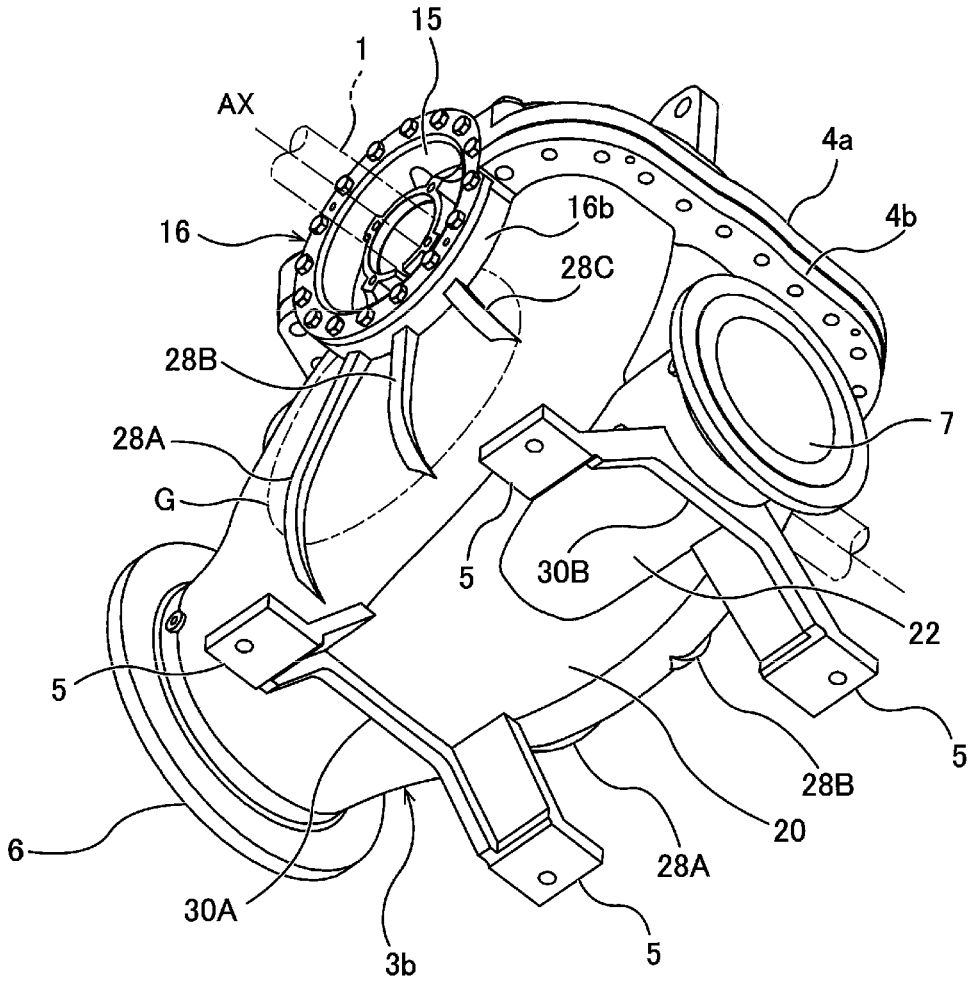
FIG. 2 is a perspective view of the double-suction centrifugal pump shown in FIG. 1 as viewed obliquely from below.
Figure 3:
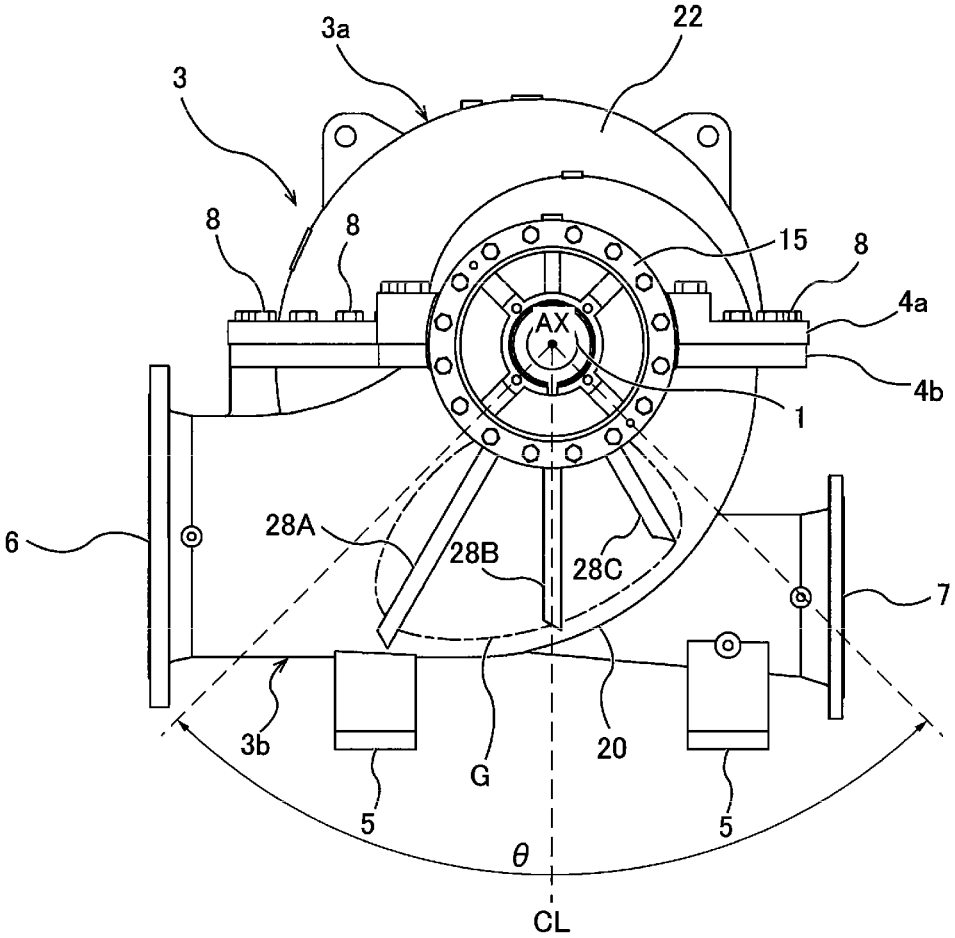
FIG. 3 is a side view of the double-suction centrifugal pump.
Figure 4:
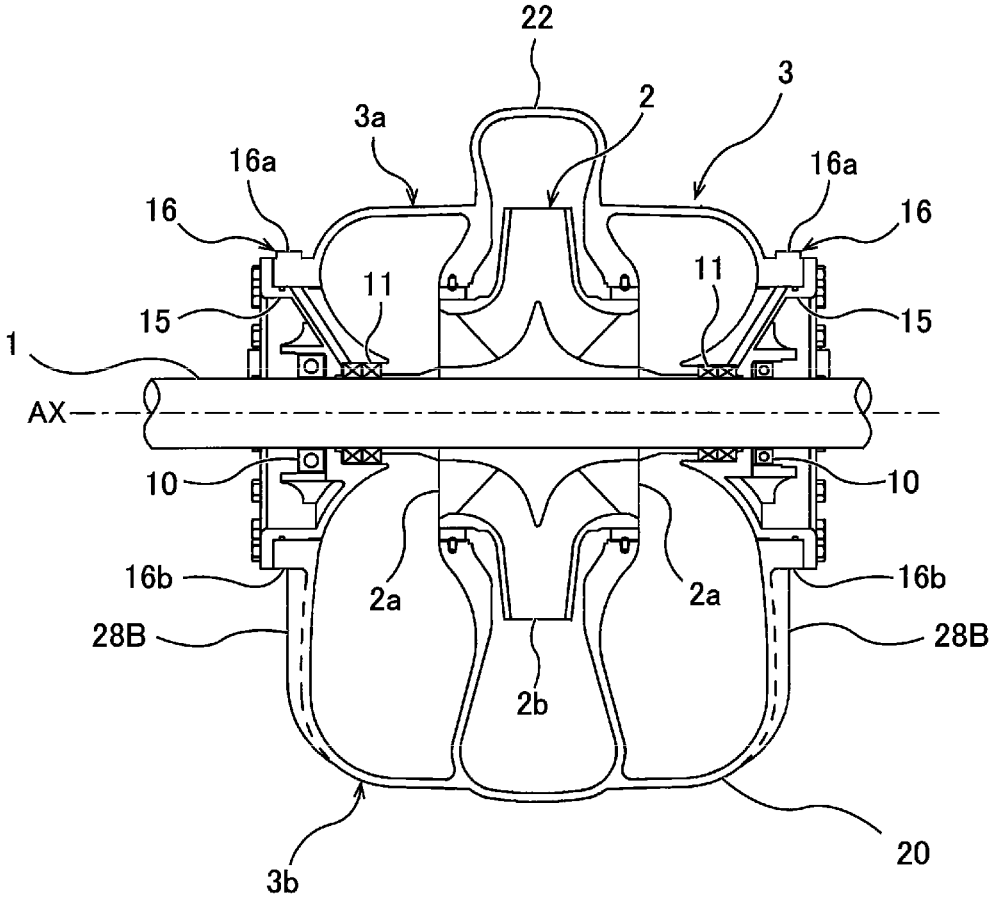
FIG. 4 is a vertical cross-sectional view of the double-suction centrifugal pump shown in FIG. 1.

Embodiments of the present invention will be described below with reference to the drawings. FIG. 1 is a perspective view of an embodiment of a double-suction centrifugal pump of the present invention as viewed obliquely from above, FIG. 2 is a perspective view of the double-suction centrifugal pump shown in FIG. 1 as viewed obliquely from below, FIG. 3 is a side view of the double-suction centrifugal pump, and FIG. 4 is a vertical cross-sectional view of the double-suction centrifugal pump shown in FIG. 1.

The double-suction centrifugal pump includes a rotational shaft 1, an impeller 2 fixed to the rotational shaft 1, a casing 3 that accommodates the impeller 2 therein and forms a liquid flow path therein, and a plurality of legs 5 secured to the casing 3. As shown in FIG. 4, the impeller 2 is a double-suction-type impeller having two liquid inlets 2*a* and one liquid outlet 2*b*. The two liquid inlets 2*a* are located at both sides of the impeller 2, and face toward opposite directions. The liquid outlet 2*b* is located at a peripheral portion of the impeller 2.

The casing 3 has a volute shape. The casing 3 includes an upper casing 3*a* and a lower casing 3*b* which are divided at a horizontal plane passing through a central axis AX of the rotational shaft 1. In this embodiment, four legs 5 are connected to a bottom of the lower casing 3*b*. This lower casing 3*b* has a suction port 6 for a liquid and a discharge port 7 for discharging the liquid pressurized by the impeller 2. The suction port 6 and the discharge port 7 face toward opposite directions.

The upper casing 3*a* and the lower casing 3*b* are fastened to each other by a plurality of bolts 8. More specifically, a lower end of the upper casing 3*a* is composed of an upper flange 4*a*, and an upper end of the lower casing 3*b* is composed of a lower flange 4*b*. The upper flange 4*a* has a mating surface facing downward, and the lower flange 4*b* has a mating surface facing upward. With a gasket (not shown) sandwiched between the mating surface of the upper flange 4*a* and the mating surface of the lower flange 4*b*, the upper flange 4*a* and the lower flange 4*b* are fastened to each other by the plurality of bolts 8.

As shown in FIG. 4, the rotational shaft 1 is rotatably supported by bearings 10 arranged on both sides of the casing 3. A gap between the rotational shaft 1 and the casing 3 is sealed by shaft sealing devices 11. The shaft seal devices 11 are, for example, mechanical seals. The bearings 10 and the shaft sealing devices 11 are attached to bearing mounting pedestals 15. These bearing mounting pedestals 15 are fitted in annular protrusions 16 formed on both sides of the casing 3. The annular protrusions 16 surround a circumferential surface of the rotational shaft 1. Upper halves of the annular protrusions 16 constitute upper semicircular annular portions 16*a* formed of a part of the upper casing 3*a*. Lower halves of the annular protrusions 16 constitute lower semicircular annular portions 16*b* formed of a part of the lower casing 3*b*. The upper semicircular annular portions 16*a* and the lower semicircular annular portions 16*b*, constituting the annular protrusions 16, extend along the circumferential surface of the rotational shaft 1.

The upper casing 3*a* and the lower casing 3*b* have a suction volute 20 communicating with the suction port 6. The suction volute 20 extends from the suction port 6 to the two liquid inlets 2*a* of the impeller 2. The upper casing 3*a* and the lower casing 3*b* further have a discharge volute 22 communicating with the discharge port 7. The discharge volute 22 extends from the liquid outlet 2*b* of the impeller 2 to the discharge port 7.

The rotational shaft 1 is coupled to a prime mover (e.g., electric motor, internal combustion engine, etc.), which is not shown in the drawings. When the rotational shaft 1 and the impeller 2 are rotated by the prime mover, the liquid is sucked into the casing 3 through the suction port 6. The liquid flows into the liquid inlets 2*a* of the impeller 2 through the suction volute 20, and is discharged from the liquid outlet 2*b* of the impeller 2 into the discharge volute 22 with the rotation of the impeller 2. The liquid flows through the discharge volute 22 and is discharged from the discharge port 7.

A plurality of ribs 28A, 28B, 28C for reinforcing the lower casing 3*b* are provided on both side surfaces of the lower casing 3*b* constituting the suction volute 20. These ribs 28A, 28B, 28C are side ribs provided on the side surfaces of the lower casing 3*b*. In this embodiment, three sets of ribs, i.e., first ribs 28A, second ribs 28B, and third ribs 28C, are provided. These ribs 28A, 28B, 28C and the lower casing 3*b* form an integral structure made of a casting. The upper casing 3*a* is also made of a casting. The ribs 28A, 28B, 28C extend across regions located at both sides of the lower casing 3*b* where high stress is generated during the water-pressure resistance test. In FIGS. 1 to 3, the regions where high stress is generated during the water-pressure resistance test are regions surrounded by dash-dot-dash lines denoted by symbol G. More specifically, the regions G are determined based on a result of stress analysis.

The ribs 28A, 28B, 28C extend over the regions G in order to prevent deformation of the lower casing 3*b* (i.e., to reinforce the lower casing 3*b*). As can be seen in FIG. 3, each region G is located below the rotational shaft 1 and extends from the lower semicircular annular portion 16*b* to the bottom of the lower casing 3*b*. Upper ends of the first rib 28A, the second rib 28B, and the third rib 28C are connected to an outer surface (lower surface) of the lower semicircular annular portion 16*b*, and lower ends of the first rib 28A, the second rib 28B, and the third rib 28C are smoothly connected to the outer surface of the lower casing 3*b*. The first rib 28A, the second rib 28B, and the third rib 28C do not intersect with each other, and extend in radial directions of the rotational shaft 1 when viewed from an axial direction of the rotational shaft 1. Since the ribs 28A, 28B, and 28C do not intersect with each other, casting defects (e.g., misrun) are unlikely to occur.

The first ribs 28A, the second ribs 28B, and the third ribs 28C are not connected to the legs 5, and are separated from the legs 5. The legs 5 have not only a function of supporting the casing 3, but also a function of suppressing vibration of the casing 3 during pump operation. Therefore, in general, the positions of the legs 5 are inevitably determined from this point of view. In contrast, the positions of the ribs 28A, 28B and 28C are determined based on sizes and positions of the regions G. In the present embodiment, since the ribs 28A, 28B, 28C are located away from the legs 5, the degree of freedom in the positions of the ribs 28A, 28B, 28C increases. Therefore, the ribs 28A, 28B, 28C can be appropriately arranged at positions necessary for reinforcing the lower casing 3*b*.

Further, the number of ribs may be changed as needed. Specifically, the number of ribs is appropriately determined by the size of the region G where high stress is generated. The size and position of the region G may vary depending on the type of pump. If the region G is small, one rib may be provided, and if the region G is large, four or more ribs may be provided.

As shown in FIG. 2, the double-suction centrifugal pump of the present embodiment includes two bottom ribs 30A and 30B extending between two sets of legs 5. These bottom ribs 30A and 30B are provided on the bottom of the lower casing 3*b*. More specifically, one set of legs 5 is connected to the suction volute 20, and the bottom rib 30A is provided on the bottom of the suction volute 20. Both ends of the bottom rib 30A are connected to the two legs 5 on the suction volute 20, respectively. The other set of legs 5 is connected to the discharge volute 22, and the bottom rib 30B is provided on the bottom of the discharge volute 22. Both ends of the bottom rib 30B are connected to the two legs 5 on the discharge volute 22, respectively. These two bottom ribs 30A and 30B extend in parallel with the central axis AX of the rotational shaft 1. The bottom rib 30A on the suction side has a function of reinforcing the bottom of the suction volute 20, and the bottom rib 30B on the discharge side has a function of reinforcing the bottom of the discharge volute 22.

As shown in FIG. 3, in the present embodiment, when viewed from the axial direction of the rotational shaft 1, the second rib 28B is located on a vertical line CL extending downward from the central axis AX of the rotational shaft 1, and the first rib 28A and the third rib 28C are located at both sides of the second rib 28B. In the present embodiment, the legs 5 are located on extension lines of the first rib 28A and the third rib 28C. It is noted, however, that the extending directions of the first rib 28A and the third rib 28C are not limited to the present embodiment. Generally, the region G where high stress is generated is located in a fan-shaped area whose central line coincides with the vertical line CL passing through the central axis AX of the rotational shaft 1 when viewed from the axial direction of the rotational shaft 1. A central angle θ of the fan-shaped area is 140 degrees or less. The first rib 28A, the second rib 28B, and the third rib 28C are located in the fan-shaped area.

Heights of the first rib 28A, the second rib 28B, and the third rib 28C gradually decrease according to distance from the upper ends of the ribs 28A, 28B, 28C. This configuration is based on a result of analyzing the stress generated in the lower casing 3*b* when water pressure is applied to the casing 3 from inside. According to the stress analysis, the stress generated in the lower casing 3*b* is the highest at the center of the suction volute 20, and gradually decreases with the distance from the lower semicircular annular portion 16*b*. The heights of the first rib 28A, the second rib 28B, and the third rib 28C gradually decrease along the gradient of the stress generated in the lower casing 3*b*. The first rib 28A and the third rib 28C have a similar configuration.

According to the present embodiment, since the heights of the ribs 28A, 28B, 28C change along the stress gradient, the ribs 28A, 28B, 28C can ensure their mechanical strength required for the lower casing 3*b*, while the entire volumes of the ribs 28A, 28B, 28C are minimized. As a result, the weight of the entire pump is reduced, and a lower cost can be achieved. Further, since the lower ends of the first rib 28A, the second rib 28B, and the third rib 28C are smoothly connected to the outer surface of the lower casing 3*b*, casting defects (e.g., misrun) are unlikely to occur at the lower ends of the ribs 28A, 28B, 28C.

As shown in FIG. 3, the first rib 28A, the second rib 28B, and the third rib 28C have different lengths, and the rib located closer to the suction port 6 is longer. Specifically, the first rib 28A, which is closest to the suction port 6, is longer than the second rib 28B, and the second rib 28B is longer than the third rib 28C which is farthest from the suction port 6. The lengths of the first rib 28A, the second rib 28B, and the third rib 28C are determined depending on the radial width of the region G. Specifically, the lengths of the first rib 28A, the second rib 28B, and the third rib 28C are equal to or longer than the radial width of the region G. The first rib 28A, the second rib 28B, and the third rib 28C have minimum lengths necessary to sufficiently reinforce the entire region G. Therefore, the volume of the entire ribs is minimized, and as a result, the weight of the entire pump is reduced, and a lower cost is achieved.

Figure 5A:
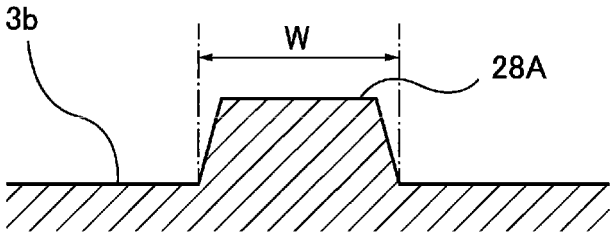
FIG. 5A is a cross-sectional view showing an example of a cross-sectional shape of a rib.
Figure 5B:
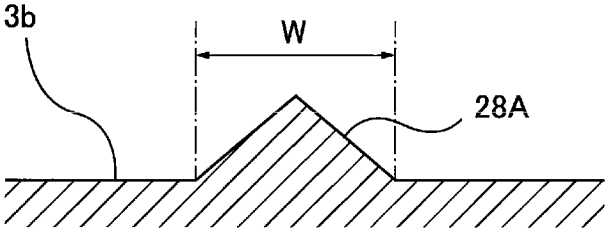
FIG. 5B is a cross-sectional view showing an example of a cross-sectional shape of the rib.
Figure 5C:
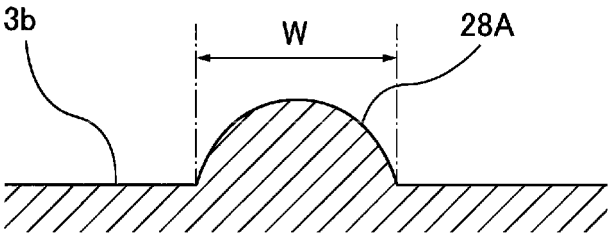
FIG. 5C is a cross-sectional view showing an example of a cross-sectional shape of the rib.
Figure 5D:
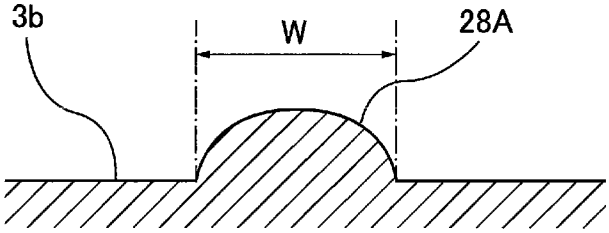
FIG. 5D is a cross-sectional view showing an example of a cross-sectional shape of the rib.

FIG. 5A is a diagram showing a cross section of the first rib 28A. In this embodiment, the first rib 28A has a trapezoidal cross section. The cross sections of the second rib 28B and the third rib 28C are also in a trapezoidal shape. In one embodiment, the cross sections of the first rib 28A, the second rib 28B, and the third rib 28C may be triangular as shown in FIG. 5B, or semicircular as shown in FIG. 5C, or semi-elliptical as shown in FIG. 5D. As shown in FIGS. 5A to 5D, a width W of the cross section of the first rib 28A gradually decreases with a distance from the outer surface of the lower casing 3*b*, so that casting defects (e.g., misrun) are unlikely to occur. However, the cross sections of the first rib 28A, the second rib 28B, and the third rib 28C are not limited to the examples shown in FIGS. 5A to 5D, and may have other shapes as long as casting defects (e.g., misrun) are unlikely to occur.

In one embodiment, the cross-sectional shape of at least one of the first rib 28A, the second rib 28B, and the third rib 28C may be different from the cross-sectional shape of the other rib(s). For example, the first rib 28A, the second rib 28B, and the third rib 28C may all have different cross-sectional shapes.

Figure 6:
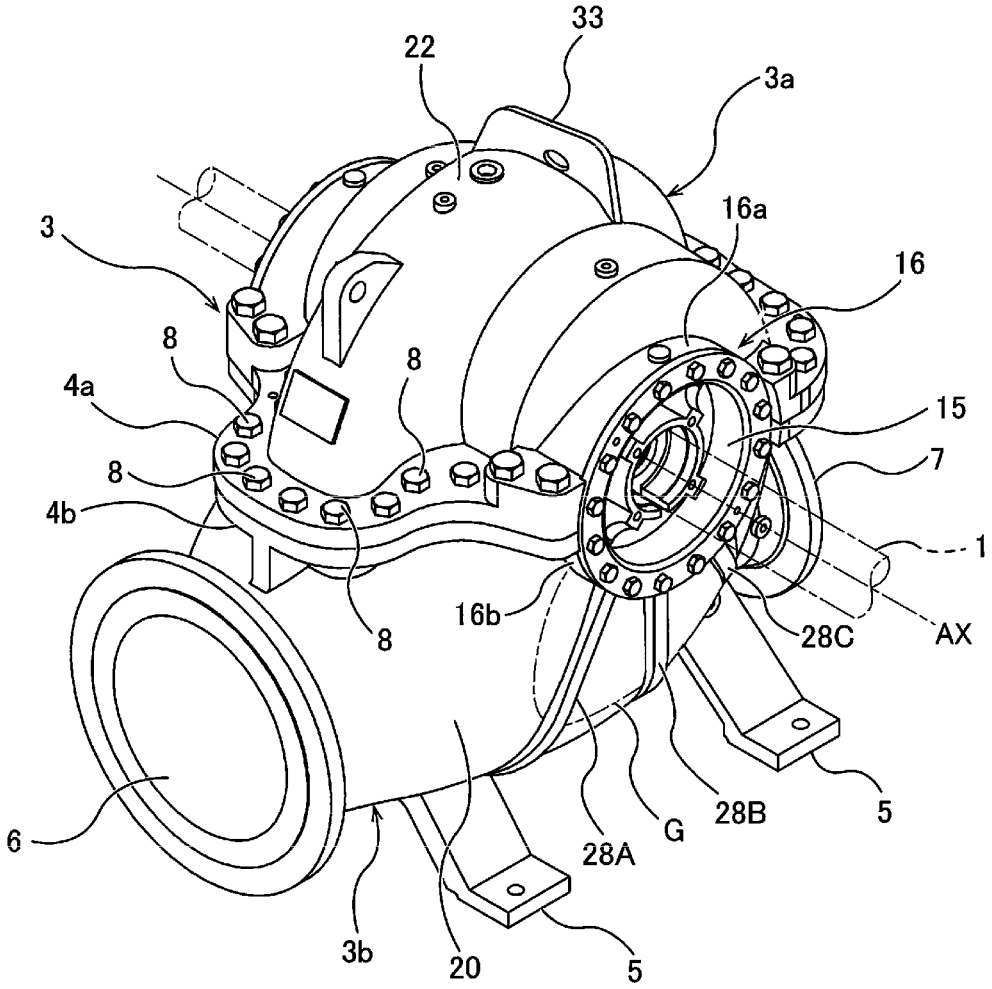
FIG. 6 is a perspective view of another embodiment of a double-suction centrifugal pump of the present invention as viewed obliquely from above.
Figure 7:
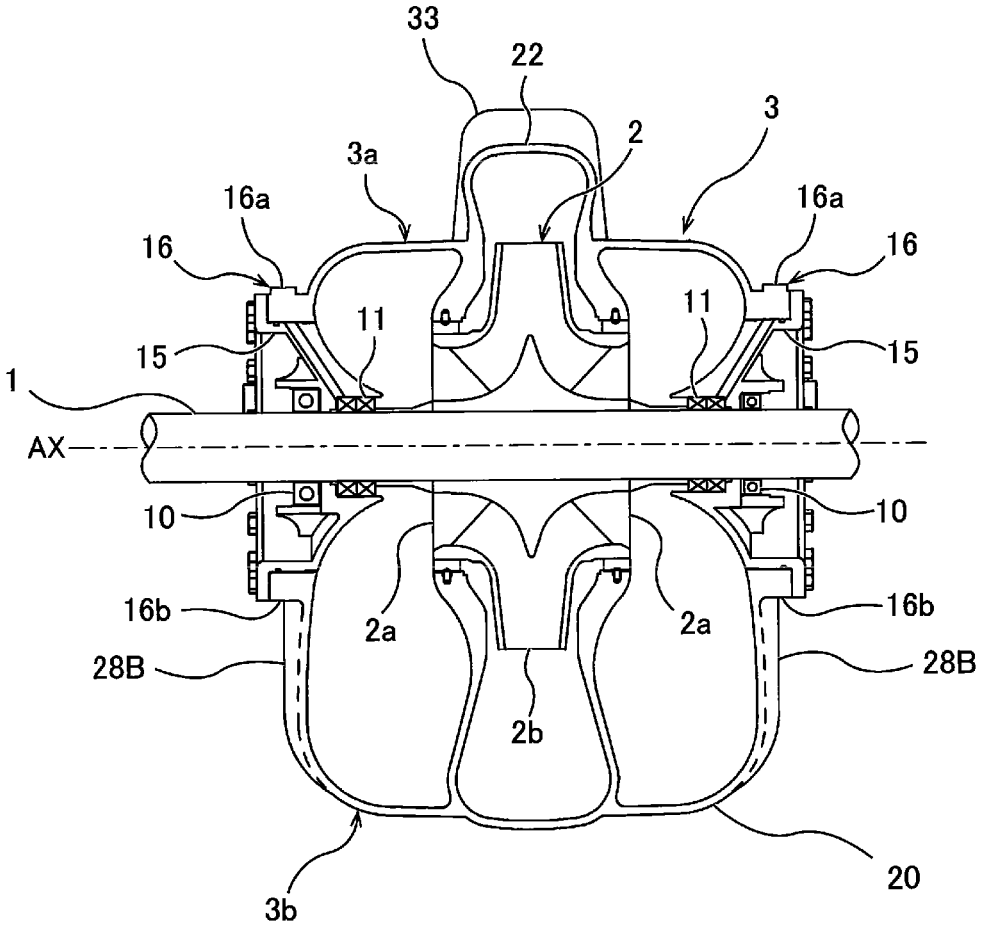
FIG. 7 is a vertical cross-sectional view of the double-suction centrifugal pump shown in FIG. 6.

FIG. 6 is a perspective view of another embodiment of the double-suction centrifugal pump of the present invention as viewed obliquely from above, and FIG. 7 is a vertical sectional view of the double-suction centrifugal pump shown in FIG. 6. Configurations of the present embodiment, which will not be particularly described, are the same as those of the embodiments described with reference to FIGS. 1 to 5, and thus the repetitive descriptions will be omitted.

As shown in FIGS. 6 and 7, the double-suction centrifugal pump further includes an upper rib 33 provided on the outer surface of the upper casing 3*a*. The upper rib 33 is located at the top of the upper casing 3*a* and extends parallel to the central axis AX of the rotational shaft 1. More specifically, the upper rib 33 is provided on the outer surface of the discharge volute 22 and extends across the discharge volute 22. In one embodiment, the upper rib 33 may extend across both the discharge volute 22 and the suction volute 20. The upper rib 33 may be located closer to the suction port 6 than the top of the upper casing 3*a*, or may be located closer to the discharge port 7 than the top of the upper casing 3*a*, as long as the upper rib 33 is on the outer surface of the upper casing 3*a*. Further, a plurality of upper ribs may be provided on the outer surface of the upper casing 3*a*.

During the operation of double-suction centrifugal pump, the discharge volute 22 is subjected to the highest liquid pressure. The upper rib 33 provided on the outer surface of the upper casing 3*a* can reinforce the upper casing 3*a* including the discharge volute 22, and can prevent deformation of the upper casing 3*a* (particularly the discharge volute 22). Further, the discharge volute 22 can be made thinner, and as a result, the weight of double-suction centrifugal pump can be reduced.

Figure 8:
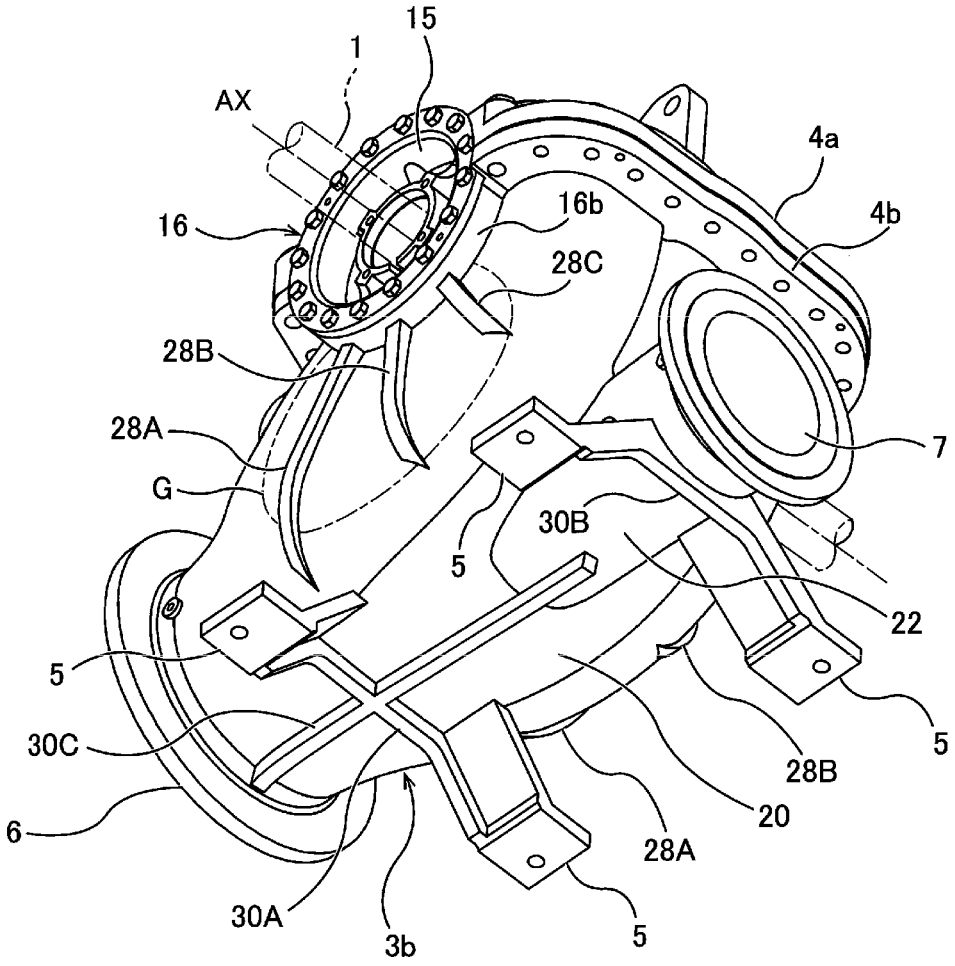
FIG. 8 is a perspective view of still another embodiment of a double-suction centrifugal pump of the present invention as viewed obliquely from below.

FIG. 8 is a perspective view of still another embodiment of the double-suction centrifugal pump of the present invention as viewed obliquely from below. Configurations of the present embodiment, which will not be particularly described, are the same as those of the embodiments described with reference to FIGS. 1 to 5, and thus the repetitive descriptions will be omitted. In the following descriptions, the bottom rib 30A provided on the bottom of the suction volute 20 will be referred to as a first bottom rib 30A.

The double-suction centrifugal pump further includes a second bottom rib 30C provided on the bottom of the lower casing 3*b*. More specifically, the first bottom rib 30A and the second bottom rib 30C are provided on the bottom of the suction volute 20. One end of the second bottom rib 30C is connected to the back side of the suction port 6, and the other end of the second bottom rib 30C is connected to the bottom of the discharge volute 22. The first bottom rib 30A is parallel to the central axis AX of the rotational shaft 1, and the second bottom rib 30C is perpendicular to the central axis AX of the rotational shaft 1. In this embodiment, the second bottom rib 30C intersects with the first bottom rib 30A at right angles. The second bottom rib 30C extends along a flow direction of the liquid sucked into the casing 3 through the suction port 6. The second bottom rib 30C arranged in this way can prevent deformation of the lower casing 3*b* due to a stress generated in the liquid-suction direction. However, the present invention is not limited to this embodiment. The bottom ribs 30A and 30C may be optimally arranged or may be at optimum angles based on the stress generated in the lower casing region G.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a reinforcing structure for a casing accommodating an impeller of a double-suction centrifugal pump.

REFERENCE SIGNS LIST

1 rotational shaft
2 impeller
2*a* liquid inlet
2*b* liquid outlet
3 casing
3*a* upper casing
3*b* lower casing
4*a* upper flange
4*b* lower flange
5 leg
6 suction port
7 discharge port
8 bolt
10 bearing
11 shaft sealing device
15 bearing mounting pedestal
16 annular portion
16*a* upper semicircular annular portion
16*b* lower semicircular annular portion
20 suction volute
22 discharge volute
28A first rib
28B second rib
28C third rib
30A,30B bottom rib
33 upper rib

What is claimed is:

1. A double-suction centrifugal pump comprising:
a rotational shaft;
an impeller secured to the rotational shaft;
a casing that accommodates the impeller therein; and
legs secured to the casing,
wherein the casing includes a suction volute that communicates with a suction port,
the casing includes an upper casing and a lower casing fastened to each other,
at least one rib is provided on each of both side surfaces of the lower casing constituting the suction volute,
the at least one rib extends in a radial direction of the rotational shaft when viewed from an axial direction of the rotational shaft, and
the at least one rib is separated from the legs,
wherein the at least one rib provided on each of both side surfaces of the suction volute comprises a plurality of ribs, and
wherein the plurality of ribs are located in a fan-shaped area whose central line coincides with a vertical line passing through a central axis of the rotational shaft when viewed from the axial direction of the rotational shaft, and a central angle of the fan-shaped area is 140 degrees or less.

2. The double-suction centrifugal pump according to claim 1, wherein the at least one rib has a height that gradually decreases with a distance from an upper end of the at least one rib.

3. The double-suction centrifugal pump according to claim 1, wherein the lower casing has a semicircular annular portion extending along a circumferential surface of the rotational shaft, and an upper end of the at least one rib is connected to the semicircular annular portion.

4. The double-suction centrifugal pump according to claim 1, wherein the at least one rib has a lower end smoothly connected to an outer surface of the lower casing.

5. The double-suction centrifugal pump according claim 1, wherein at least one of the plurality of ribs has a cross section different from a cross section of another one of the plurality of ribs.

6. The double-suction centrifugal pump according to claim 1, wherein the legs are located on extension lines of the plurality of ribs.

7. The double-suction centrifugal pump according to claim 1, further comprising at least one upper rib provided on an outer surface of the upper casing.

8. The double-suction centrifugal pump according to claim 1, further comprising at least one bottom rib provided on a bottom of the lower casing.

9. A double-suction centrifugal pump comprising:

a rotational shaft;

an impeller secured to the rotational shaft;

a casing that accommodates the impeller therein; and legs secured to the casing, wherein the casing includes a suction volute that communicates with a suction port, the casing includes an upper casing and a lower casing fastened to each other, at least one rib is provided on each of both side surfaces of the lower casing constituting the suction volute, the at least one rib extends in a radial direction of the rotational shaft when viewed from an axial direction of the rotational shaft, and the at least one rib is separated from the legs, wherein the at least one rib provided on each of both side surfaces of the suction volute comprises a plurality of ribs, and wherein the plurality of ribs have different lengths, and a respective rib closer to the suction port is longer.

* * * * *